US005251879A

United States Patent [19]

Floyd

[11] Patent Number: 5,251,879

[45] Date of Patent: Oct. 12, 1993

[54] TOP SUBMERGED INJECTION WITH A SHROUDED LANCE

[76] Inventor: John M. Floyd, 70-72 Emerald Road, Upper Beconsfield, Victoria 3808, Australia

[21] Appl. No.: 842,103

[22] PCT Filed: Sep. 26, 1990

[86] PCT No.: PCT/AU90/00466

§ 371 Date: Mar. 20, 1992

§ 102(e) Date: Mar. 20, 1992

[87] PCT Pub. No.: WO91/05214

PCT Pub. Date: Apr. 18, 1991

[30] Foreign Application Priority Data

Sep. 29, 1989 [AU] Australia ..... PJ6615

[51] Int. Cl.[5] ..... F27D 3/16

[52] U.S. Cl. ..... 266/44; 266/225

[58] Field of Search ..... 266/44, 225, 142, 265

[56] References Cited

U.S. PATENT DOCUMENTS

| | | | |
|---|---|---|---|
| 3,521,872 | 7/1970 | Themelis | 266/265 |
| 3,730,505 | 5/1973 | Remacciotti et al. | 266/225 |
| 3,802,681 | 4/1974 | Pfeifer | 266/225 |
| 3,828,850 | 8/1974 | McMinn et al. | 165/109 |
| 3,889,933 | 6/1975 | Jaquay | 266/265 |
| 4,023,676 | 5/1977 | Bennett et al. | 266/222 |
| 4,097,030 | 6/1978 | Desaar | 266/225 |
| 4,251,271 | 2/1981 | Floyd | 266/225 |
| 4,326,701 | 4/1982 | Hayden, Jr. et al. | 266/225 |
| 4,396,182 | 8/1983 | Schaffar et al. | 266/265 |
| 4,541,617 | 9/1985 | Okane et al. | 266/265 |
| 4,880,044 | 6/1970 | Shepherd | 266/225 |

FOREIGN PATENT DOCUMENTS

| | | |
|---|---|---|
| 0032822 | 12/1981 | Chile . |
| 0032875 | 12/1981 | Chile . |

OTHER PUBLICATIONS

Abstract Accession No. 84-167341/27 re JP-A-5-9-089710 (Kawasaki Steel KK) Nov. 11, 1982 "Simultaneous Increase of Scrap Rate and Metal Yield in the BOF in Combination with Bath Stirring" by Kreijger.

*Primary Examiner*—Scott Kastler

*Attorney, Agent, or Firm*—Watts, Hoffmann, Fisher & Heinke Co.

[57] ABSTRACT

A lance comprising a first elongate tube extending through an elongate tubular shroud, is used for top submerged injection of a fluid into a liquid pyrometallurgical bath comprising slag or having slag on its surface. The first tube defines a duct for the flow of the fluids. The shroud defines a flow passage for a coolant such as air. The shroud terminates above the lower end portion of the first tube. In use, the coolant cools the lance and discharges into the bath when the outlet of the first tube is inserted into the bath.

11 Claims, 1 Drawing Sheet

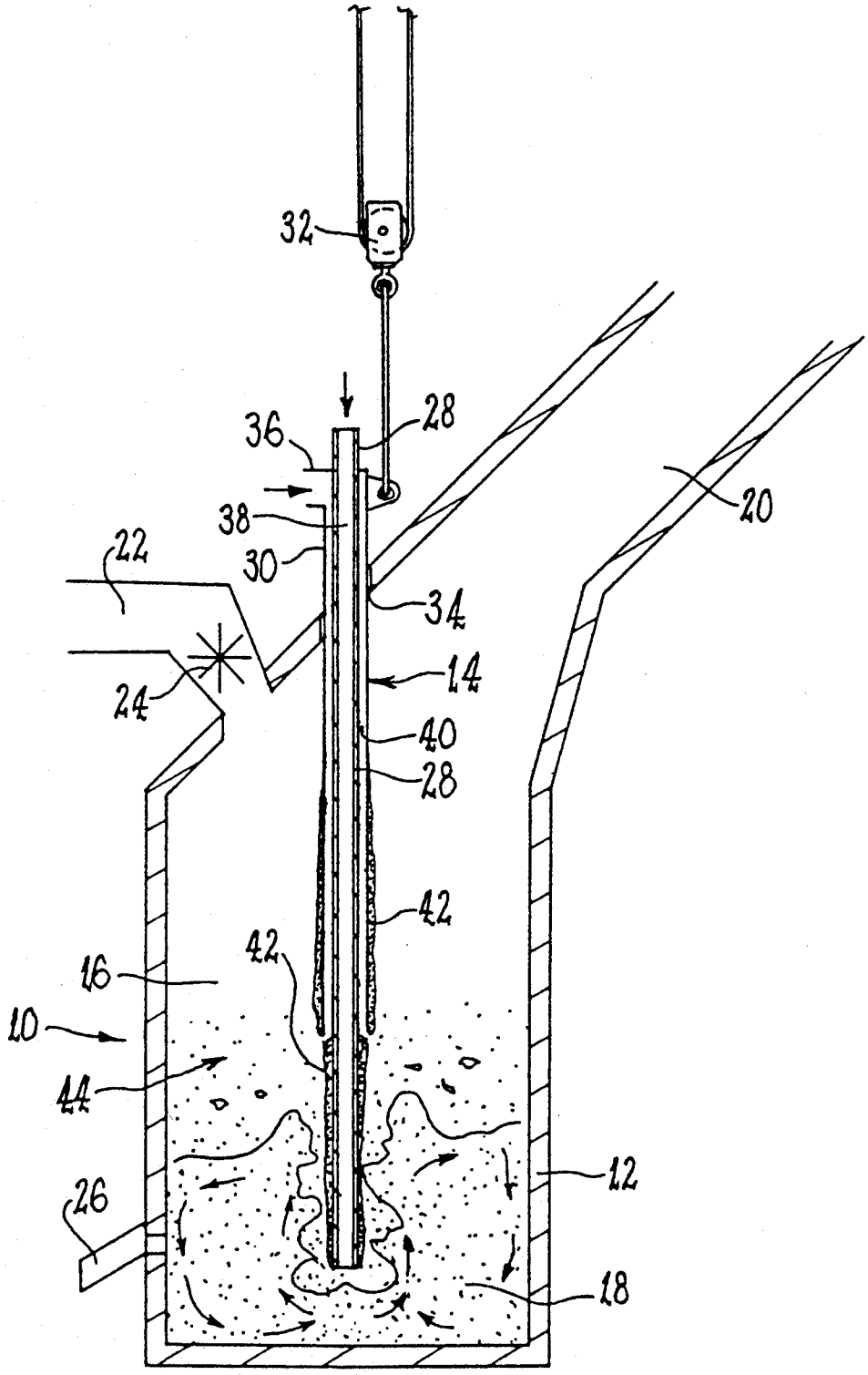
32
28
36
38
30
22
24
34
14
40
28
42
42
16
10
44
26
12
18
20

TOP SUBMERGED INJECTION WITH A SHROUDED LANCE

This invention provides an improved top submerged lancing system and an improved method for top submerged injection of fluid in a pyrometallurgical operation.

Top submerged lancing provides a method of injecting gas into a pyrometallurgical bath wherein the gas is injected through a lance having an interior duct for flow of gas therethrough and a discharge end at which the gas is discharged. Such method is disclosed in U.S. Pat. No. 4,251,271 issued 17 Feb. 1981 to Floyd. The method disclosed by Floyd is characterized by the steps of presenting the discharge end of the lance to a molten bath of slag, forcing gas through the lance to cool and splash-coat the discharge end of the lance with molten slag, and inserting the thus coated discharge end of the lance into the pyrometallurgical bath. Also disclosed is a lance for submerged injection of gas into a liquid pyrometallurgical bath comprising a duct for flow of gas longitudinally through the lance characterized in that the outer wall of the duct is defined by an elongate tube constituting an outer wall of the lance, with a gas flow swirler means being provided within the tube to impart swirl to gas passed through the duct.

The lance disclosed in U.S. Pat. No. 4,251,271 (hereinafter referred to as the Sirosmelt lance) has allowed the development of a wide range of metallurgical processes using a slag bath as a heat and mass transfer medium for submerged combustion and metallurgical process reactions. Examples include smelting, fuming and slag treatment processes to recover tin, lead, zinc, nickel, copper, precious metals and other valuable metals from ores, concentrates, slags, fumes and waste materials.

In practice the operation of the Sirosmelt lance gives many advantages over other metallurgical processes and, as a result, systems using the Sirosmelt lance have become accepted as efficient and cost effective. However the operation of the Sirosmelt lance has certain limitations which cause its use to be problematical for operators. The tip of the lance is subject to wear, and lance removal is required on occasions to replace the tip of the lance. The use of high-temperature steels or other special materials for the tip can be beneficial in prolonging its life, but tip repairs are an essental part of the maintenance of systems using the Sirosmelt lance. The base cause of this tip erosion is the fact that the gases passing through the lance become too hot to prevent reaction between the material of the lance and the bath content or the injected gas. Under some conditions, tip wear can be so severe as to necessitate use of several lances in succession in each shift of operation.

For steel lance tips it is found that the gases must be maintained at temperatures below about 400° C. for many operations to avoid the wear. There are certain circumstances where it is not possible to maintain temperatures below 400° C. in the gases because the quantity of heat transferred through the outer wall of the lance is too great for the quantity of gas flowing through the lance. The quantity of heat flowing through the lance wall is proportional to the heat transfer rate through the slag coating and lance wall, and also proportional to the outer surface area of the lance. The quantity of gas passing through the lance is determined by the process requirements. Thus the design of a lance for a particular application is constrained by the gas flow rate for a given operating regime and the total outer surface area to prevent lance tip wear.

The lance operating regimes which cause lance tip wear problems are as follows:

1. Use of a lance in a furnace where a large height above the bath is needed and limited gas flowrate is needed. An example of this is the use of a lance in an Outokumpu flash furnace for removing furnace accretions. The gas flowrate useable may be limited by the degree of splashing which can be accepted without causing undue wear of roof refractories, which are not designed for splashing contact with slag. Thus there is not enough gas injected to cool the lance for solidification of a slag layer without the gas temperature exceeding 400° C. and the lance suffering rapid wear.

2. Use of a lance for a similar duty to regime 1, but with a very high furnace freeboard in the furnace. In this case the surface area passing heat to the gas can be excessive because of the length of the lance. The problem in this context can be particularly severe where evolved gases are combusted in the furnace, to oxidize evolved metal values prior to their discharge with flue gases.

3. The use of a lance with features such as high levels of oxygen enrichment and/or internal injection pipes for powdered feed or reactants which causes the outer diameter of the lance to be increased beyond that which can be accommodated without excessive temperatures being caused in the gases.

4. Operation of the lance for long periods above the bath without a slag coating, particularly at low flow rates for gas injected through the lance. The rate of heat transfer through the bare steel outer pipe is much greater than when a slag coating is formed, and so the quantity of heat transferred to the gas is much greater and the lance tip will suffer wear.

5. Operation of the lance in a slag bath at temperatures greatly in excess of the liquidus temperature of the slag. This causes only a thin layer of slag to be formed on the lance. The rate of heat transfer is then higher than when a thicker layer of slag is present and lance tip-attack becomes a problem.

6. The difficulty of regime 5 becomes particularly problematical when the temperature of the furnace is very high. For example iron silicate slags have liquidus temperatures which are typically in the region of 1150° to 1250° C. and operations at 1300°–1400° C. give a slag thickness of the order of 10 to 20 mm, which results in acceptable rates of heat transfer. Raising the temperature to 1500°–1600° C. can be required for process reasons, and the operation of the simple Sirosmelt lance can become very difficult because of rapid tip wear.

Lances in general have a limited injected gas flow range over which they can operate. The upper limit of the range is established as the maximum achievable at a given supply pressure, which is normally 300 to 400 kPa, with a given swirler and lance configuration. The lower limit of the range is established as the minimum for maintenance of the slag layer coating by suitable cooling. However, flow rates below this limit are desirable in some instances to effectively increase the turndown ratio. For example, a lance designed for a maximum flow of about 3000 $Nm^3/hr$ of air typically will have a minimum flow requirement of about 1200 $Nm^3/hr$ before lance tip wear becomes a problem. However, in some applications, it can be desirable to have a flow rate as low as about 600 $Nm^3/hr$.

This invention provides an improved lance which overcomes or alleviates at least some of the problems outlined above. The invention also provides an improved method of injecting fluid into a liquid pyrometallurgical bath utilizing such improved lance, and an improved top submerged lancing furnace installation having such improved lance.

A lance according to the invention comprises at least a first elongate tube which defines a duct for the flow of fluid through the lance for top submerged injection into a liquid pyrometallurgical bath, and an elongate tubular shroud mounted in relation to the first tube, and through which the first tube extends, so as to define a coolant fluid flow passage between the first tube and shroud; the shroud terminating above a lower end portion of the first tube. The shroud is connectable by suitable fixtures and connections, by means known in lance technology, to a suitable fan, blower or compressor which supplies coolant gas to the flow passage. In use of the lance, gas to be injected into a liquid bath initially is injected through the first tube with the lower end portion of the tube spaced above the bath surface, so as to splash coat that lower end portion of the lance. Coolant gas simultaneously is charged through the flow passage between the shroud and the first tube and discharges above the bath. The lance then is lowered so as to insert the slag-coated lower end portion of the first tube into the bath, while maintaining the lower end of the shroud above the bath surface to enable discharge of the coolant gas into the gas space above the bath.

The improved lance preferably has a first tube of the same overall form as the lance disclosed in U.S. Pat. No. 4,251,271. That is, the first tube preferably includes a central core, such as a rod or inner second tube, with a helically spiralled swirler strip extending around the rod or second tube to provide a helical flow path for gas injected through the first tube for top submerged injection into the bath. Where fuel must be provided to make up for heat losses, overall endothermic reactions or heating of the bath, the fuel can be injected through a central tube within the inner second tube, or through the bore of the inner second tube.

The provision of a shroud, and injection of coolant gas between the shroud and first tube, enables sufficient additional cooling of the lance to overcome the above problems. This arrangement effectively limits the surface area of the lance for heat transfer to gas injected through the first tube. The lance of the invention thus extends the range of applications in which top submerged injection of gas into a bath can be performed efficiently with minimum tip wear. That is, the lance of the invention can be used under more extreme conditions under which the Sirosmelt lance either is not usable or is prone to excessive tip wear, since the temperature of gas injected through the first tube can be kept at a level at which excessive tip wear is obviated.

The coolant gas is designated herein as a coolant gas principally only in relation to its intended benefit in relation to the lance. It may comprise air, a mixture of air and oxygen, or an inert gas such as nitrogen. It most typically will comprise air.

As indicated, the shroud terminates above the lower end portion of the first tube so that the coolant gas discharges into the gas space above the bath. Such discharge occurs simultaneously with injection of oxygen containing gas into the bath, such as with injected fuel and reactants. Where the coolant gas is air or an air/oxygen mixture, its discharge into the gas space can have significant beneficial effects on a pyrometallurgical operation being performed on the bath. For example, when zinc is being fumed from slag, the operation can be carried out so that elemental zinc, carbon monoxide and hydrogen are evolved from the bath. In order for the operation to be fuel efficient, it is desirable that these evolved gases be burnt above the bath in such a manner that heat from their oxidation to ZnO, $CO_2$ and $H_2O$ is efficiently recovered in the bath, but such that the bath itself is not re-oxidized. This balance can be achieved by controlling the rate of supply, and level of discharge of the coolant gas above the bath, with the oxygen content of the coolant gas enabling such oxidation.

The invention also provides a method of injecting fluid into a liquid pyrometallurgical bath comprising slag or having a slag on its surface, the method comprising the steps of:

(a) passing the fluid through the first tube of a lance according to the invention for discharge through a lower, discharge end of the first tube;

(b) simultaneously with step (a), passing a coolant gas through the passage between the first tube and the shroud of the lance for discharge at a lower, discharge end of the shroud;

(c) lowering the lance to a first position at which the discharge end of the first tube is adjacent to the surface of the slag whereby the fluid being discharged from the first tube causes splashing of the slag;

(d) holding the lance in that position whereby splashes of slag deposit exteriorly on the first tube and the shroud;

(e) maintaining a sufficient flow of coolant gas through the passage such that the coolant gas in combination with the fluid cools the lance to thereby solidify the splashes of slag deposited on the lance to form a protective coating of solid slag; and (f) lowering the lance to a second position inserting the discharge end of the first tube into the bath for discharge of the fluid therein, the discharge end of the shroud with the lance in the second position being above the bath whereby the coolant gas continues to cool the lance prior to discharge of the coolant gas above the surface of the slag.

The invention further provides a top submerged lancing furnace installation for use in injecting fluid into a liquid pyrometallurgical bath comprising slag or having a slag on its surface, the installation comprising:

(a) a furnace in a lower region of which the liquid bath is able to be established to a required level;

(b) at least one lance according to the invention;

(c) means for lowering the lance into the furnace, the lowering means being operable to lower the lance to a first position at which the discharge end of the first tube is adjacent to the surface of the slag and, after holding the lance at the first position, to further lower the lance to a second position in which the discharge end of the first tube is inserted into the bath with the discharge end of the shroud being above the bath;

the first tube of the lance being connectable at the upper end thereof to a source of pressurised fluid to be passed through the first tube during and after lowering of the lance whereby fluid being discharged from the first tube causes splashing of the slag so that slag deposits exteriorly on the first tube and the shroud, with the lance in the first position, to enable splashes of slag on the lance to form a protective coating, and whereby the discharged fluid is injected into bath with the lance in the second position; the shroud being connectable at the upper end thereof to a source of pressurised coolant gas to be passed through the passage between the shroud and the first tube during and after lowering of the lance whereby the coolant gas in combination with the fluid cools the lance so that, with the lance in the first position, the splashes of slag solidify to form such protective coating, and whereby the coolant gas is discharged into the furnace above the bath, with the lance in the second position, to continue to cool the lance.

A lance according to the invention can vary according to the specific application. As indicated above, the first tube of the lance may correspond in overall form to a lance as disclosed in U.S. Pat. No. 4,251,271. In its smallest form, the first tube typically is about 2 meters long and has an external diameter of about 25 to 35 mm. In such case, the shroud typically may have an internal diameter of from 30 to 40 mm, providing an annular gap of about 2.5 to 5 mm.

An intermediate size of lance according to the invention typically has a first tube of about 7 meters long and has an external diameter of the order of about 75 mm. For such first tube the lance may have a shroud with an internal diameter providing an annular gap of about 4 to 10 mm.

A largest typical lance according to the invention, suitable for example in smelting copper in a furnace having an output of 100 tons or more per hour, has a first tube of about 10 meters in length or more, with an external diameter of from 200 to 400 mm. In this case, the shroud typically may have an internal diameter providing an annular gap of from 5 to 20 mm or more.

The wall thickness for the first tube and shroud can range from about 2 mm for a small lance, to 4 to 6 mm or more for a large lance.

In use of a lance according to the invention, the lower end portion of the first tube, above which the shroud terminates, typically has a length allowing for insertion of up to one meter of the first tube into the bath. The shroud therefore typically terminates at least 1500 mm short of the lower end of the lance. However, in some instances, such as where the coolant gas issuing from the shroud is one containing oxygen and is to enable evolved gases to be burnt close to the surface of the bath to maximise heat input to the bath, the shroud may terminate only 300 to 1000 mm from the lower end of the first tube. The coolant gas then is able to issue close to the bath surface for such combustion.

A principal requirement is that the shroud terminates sufficiently above the lower portion of the first tube to enable insertion of that portion into the bath. The shroud may terminate a short distance above that portion, as indicated above. However, it alternatively may terminate a signficant distance above that portion, such as from about $\frac{1}{4}$ to $\frac{1}{3}$ of the length of the lance from its lower end in larger lances. In the latter regard, a requirement is that the shroud discharges the coolant gas at a height above the bath consistent with the requirements for the smelting process to which the bath is to be subjected.

In use of the lance of the invention, it generally is not required that the coolant gas is injected under substantial pressure as with gas injected through the first tube. Indeed, it generally is sufficient to charge the coolant gas under the action of a fan or blower. Where combustion of evolved gases is not required, it typically is sufficient for the coolant gas to be charged at a velocity of about 25 to 75 $m.sec^{-1}$; such as to achieve a volume of about 100 to 1000 $m^3$ per hour. Where the bath is to be subjected to very high temperatures with a low oxygen partial pressure being maintained in the furnace space above the bath, nitrogen preferably is used as the coolant gas. However, where combustion of evolved gases is required, an oxygen containing gas is used, typically at a substantially higher volume per hour than indicated above but depending on the extent of combustion required.

BRIEF DESCRIPTION OF THE DRAWINGS

With reference to the accompanying drawing, there is shown an improved lance according to the invention, illustrated in relation to a furnace installation according to the invention.

The installation 10 of the drawing has a refractory lined furnace 12 in which a lance 14 is provided. Furnace 12 defines a chamber 16 in which, during a pyrometallurgical operation, there is established a liquid bath 18 comprising slag or having slag layer on its surface. Gases evolved during the operation pass into the gas space of chamber 16 above bath 18, and discharge via flue gas off-take 20. Furnace 12 also has a feed chute 22 by which feed material or solid reactants can be charged to bath 18 under the control of feed valve 24, and a tap hole 26 by which treated slag and/or metal phase can be tapped from the furnace.

Lance 14 has a first tube 28 and an elongate, tubular shroud 30 through which tube 28 extends. Lance 14 is shown in a lowermost position, as required for the operation to be conducted on bath 18. Lance 14 is supported in that position by means of an overhead mechanism 32, such as a crane, by which the lance can be raised and lowered through opening 34 in the roof of furnace 12.

At the upper end of lance 14, tube 28 is adapted for connection to a source of pressurised fluid, such as by a flexible conduit. Also, at that end, shroud 30 is closed around tube 28 but provided with a side connector 36 by which shroud 30 is adapted to be connected to a source of pressurised coolant gas. Thus, the pressurised fluid is able to be caused to pass downwardly through bore 38 of tube 28, for discharge from the lower end thereof. Also, coolant gas is able to be caused to pass downwardly through passage 40 between tube 28 and shroud 30, for discharge at the lower end of shroud 30. As shown, shroud 30 terminates with its lower end above the lower end of tube 28. The extent to which shroud 30 terminates above the lower end of tube 28 can vary, as described herein, but the arrangement is such that with the lower end of tube 28 inserted to a required depth in bath 18, the lower end of shroud 30 is above the surface of bath 18. Thus, while fluid caused to discharge from tube 28 is injected into bath 28, with lance 14 in the lowermost position shown, coolant gas is discharged from passage 40 into the air space of chamber 16 above bath 18.

Lance 14 is brought to its lowermost position, from an elevated position in which it is clear of bath 18, by operation of mechanism 32. Lance 14 is lowered with fluid being passed down through tube 28 and with coolant gas being passed down through passage 40. Lowering of lance 14 is stopped when it is at a first position in which the lower, discharge end of tube 28 is adjacent the surface bath 18. The fluid being discharged from that end of tube 28 causes splashing of slag from bath 18 so that splashes of slag deposit on the exterior surface of each of tube 28 below shroud 30 and of shroud 30. The flow of coolant gas through passage 40 is maintained at a flow rate such that, in combination with flow of the fluid through tube 28, lance 14 is maintained at a temperature at which the splashes of slag so deposited solidify to form a protective coating 42 on shroud 14. The lance then is lowered to a second position, corresponding to that illustrated in the drawing.

With lance 14 in the second position as illustrated, flow of the fluid through tube 28 is continued such that the fluid is injected into bath 18. Also, flow of coolant gas through passage 18 is continued but, as the lower end of shroud 30 is above bath 18, that gas discharges into the air space above melt 18. However the flow of coolant gas is maintained at a level such that tube 28 is cooled thereby, such that despite heating of tube 28 by conduction from bath 18, the fluid being injected into bath 18 is maintained at a relatively low temperature, such as below about 400° C., consistent with minimising wear of the tip of tube 28.

The range of operations able to be conducted on bath 18 will readily be understood, and therefore will not be detailed herein. However, typically, the fluid injected into bath 18 via tube 28 will be an oxygen containing gas, such as air. The fluid may also include particulate fuel, such as coal, or liquid fuel such as oil may be injected through a further tube in bore 38. The overall arrangement may, for example, be such as to generate a combustion zone adjacent the lower end of tube 28, with a reduction zone prevailing at least at the surface of bath 18. During operation, the temperature of lance 14 is such that protective coating 42 is maintained; indeed, it may be increased above bath 18 by further slag splashes 44 being generated.

In lance 14, tube 28 thereof may be in accordance with the lance of FIG. 1 or FIG. 2 of U.S. Pat. No. 4,251,271, the disclosure of which is incorporated herein by reference and to be read as part of the present invention. Thus, tube 28 can comprise a tube having a central rod disposed therein, with a swirler strip spiralled around that rod. Such arrangement is suitable where the fluid to pass through tube 28 is a gas, or a gas having fine entrained particulate material such as coal. Alternatively, tube 28 may have a second tube mounted concentrically therein, with the swirler around the second tube. With that alternative, the fluid to pass through tube 28 may comprise a gas, or gas with fine entrained particulate material, while the second tube can be used for injecting fuel oil into the bath. The oil may simply pass within the inner tube, or through a further tube therein, the inner tube or further tube preferably terminating at its lower end at an atomizing nozzle.

The shroud 30, in addition to enabling provision of coolant gas resulting in reduction or avoidance of tip wear, protects tube 28 above bath 18 from direct exposure to hot gas in the furnace. Thus, shroud 30 can prevent heating of tube 28 to a temperature level at which it can be physically weakened. In prior art arrangements, it is found that the lance can be weakened to an extent that it bends, resulting in difficulty in then raising the lance, while the lance can even rupture.

As detailed, the coolant gas may comprise an oxygen containing gas. In such case, it can be used to supply the oxygen requirement for combustion of fume evolved from bath 18. Such arrangement has advantages over the alternative of providing gas ports around furnace 12, above bath 18, for the supply of oxygen containing gas, as such ports are prone to blocking by splashed slag and are difficult to unblock. However, the coolant gas can, if required, comprise an inert gas, such as nitrogen, where combustion of fume in furnace 12 is not required.

Lance 14 can vary in its overall dimensions, depending in part on the size of furnace 12 and on the operation to which bath 18 is to be subjected. However, lance 14 typically is such that tube 28 has a length of from 2 to at least 10 meters in length with shroud 30 terminating from 300 to 1000 mm above the lower end of tube 28. Apart from a lower portion of tube 28 which projects below the lower end of shroud 30, the full extent of tube 28 within furnace 12, with lance 30 at its lowermost position, is within shroud 30. However, as shown, it is preferred that tube 28 and shroud 30 both project above the top of furnace 12 when lance 14 is in that position. The lower end of shroud 30 may, for example, be from about ¼ to ⅓ of the length of lance 14 above the lower end of tube 28.

Typically, the diameter of tube 28 and the radial extent of passage 40 varies with the overall length of lance 14. Thus, the external diameter of tube 28 and the radial width of passage 40 may range from about 25 to 35 mm and 2.5 to 5 mm, respectively for a small 2 to 5 meter long lance, with tube 28 having a wall thickness of about 2 mm. The external diameter of tube 28 may range up to about 35 to 100 mm for an intermediate size lance of about 4 to 8 meters long, to in excess of 100 mm such as from 200 to 400 mm for a large lance in excess of 8 meters, such as of about 10 or more meters, in length. The width of passage 40 may correspondingly increase to about 4 to 10 mm for an intermediate lance to 5 to 20 mm or more for a long lance. The wall thickness of tube 28 may correspondingly increase to from 4 to 6 mm or more for intermediate and long lances. Shroud 30 may have a wall thickness substantially corresponding to that of its tube 28.

While conventional means preferably are used to supply fluid to tube 28, less pressurization generally is appropriate for coolant gas supplied to passage 40. It is preferred that a fan or blower be used for supplying the coolant gas, although a compressor can be used.

EXAMPLE 1

Difficulties were experienced with an Outokumpu flash smelting furnace in the flow of slag out of the bath of the furnace, due to a build-up of accretions in the bath. A Sirosmelt lance according to U.S. Pat. No. 4,251,271 had previously been tried in the system, but had been unsuccessful due to excessive lance-tip wear experienced both in preventing formation of the accretions and in melting the accretions once formed. That is, in that situation, the Sirosmelt lance could only be operated under conditions providing a sufficient heat transfer in the bath if excessive tip-wear was to be tolerated. Installation of a lance according to the invention enabled operation providing such heat transfer and melting of the accretions, and continued efficient operation without accretions reforming, due to the lance being cooled by coolant air injected through the passage between the shroud and first tube and discharging above the bath.

EXAMPLE 2

A pilot plant, substantially corresponding to the installation of the drawing, was operated under conditions whereby zinc was fumed from slag at high temperatures, using a conventional Sirosmelt lance according to U.S. Pat. No. 4,251,277. The lance tip was found to suffer rapid wear such that the operation could not be continued. The Sirosmelt lance was replaced by a lance according to the invention and operation resumed with coolant air injected through the passage between the shroud and first tube so as to discharge into the air space above the slag. The replacement lance was found not to suffer problems with tip wear. Furthermore, it was established that 80% of heat available from combustion of gases evolved during fuming operation was recovered in the bath of the furnace, thereby substantially increasing overall energy efficiency of the fuming operation.

In addition to being operable in applications in which the Sirosmelt lance is of limited utility or cannot be used, the lance of the invention can be varied in form or in use in a given application. Thus, the composition and/or flow rate of the coolant gas can be varied as required, such as by increasing or decreasing for example the amount of oxygen discharged to the gas space above the melt. Also, the diameter of the shroud can be chosen to suit a given furnace requirement to achieve a required balance between coolant gas flow rate and volume per unit of time. Also, the height at which the shroud terminates above the lower end portion of the first tube can be selected to suit the requirements for operation in a given furnace. Additionally, if required, an annular collar or deflector can be fitted to the first tube, below the lower end of the shroud, so that coolant gas is directed laterally from the lance within the gas space above the bath, so as to substantially preclude coolant gas from impinging directly on the bath surface. Such collar may be in the form of a deflector attached to the external surface of the first tube, below the end of the shroud. Alternatively, the shroud can be partly sealed with an annular disc welded to its lower end, with provision of suitable coolant gas outlet passages in the annular disc or the shroud to control the direction and level of discharge of coolant gas.

The lance of the invention enables some of the limitations of the Sirosmelt lance to be overcome. Thus, the cooling of the lance by coolant gas charged between the shroud and first tube enables a limited gas flow rate such as is needed to melt accretions in an Outokumpu flash furnace. Also, a lance having a large surface area passing heat can be more extensively used, while more extreme furnace operating temperatures can be accommodated. A slag coating is more readily able to be maintained over a wider range of operating temperatures and injected gas flow rates, thereby minimising lance tip wear and down-time for tip replacement. The lance of the invention can accommodate an injected gas flow rate substantially below that acceptable with the Sirosmelt lance, with resultant overall increase in turn-down ratio compared with a conventional lance.

It will be appreciated that various alterations, modifications and/or additions may be introduced into the constructions and arrangements of parts previously described without departing from the spirit or ambit of the invention.

I claim:

1. A lance, for top submerged injection of a liquid pyrometallurgical bath comprising slag or having a slag layer on its surface; the lance, relative to an in-use orientation, being of elongate form between an upper inlet end thereof and a lower discharge end for said fluid; the lance having a lower portion which terminates at said discharge end and which, in use, is submergible in said slag; the lance comprising:

(a) at least one first elongate tube which extends between said upper and discharge ends and which defines a duct for the flow of said fluid from the inlet end for discharge from the discharge end, the at least one first tube defining said lower portion;

(b) an elongate, tubular shroud which is mounted in relation to the first tube, and through which the first tube extends so that a coolant gas flow passage is defined within the shroud and around the first tube;

(c) first connector means, at said inlet end, connectable to a pressurized source of supply of said fluid for flow of said fluid through said duct; and (d) second connector means, at said inlet end, connectable to a pressurized source of supply of said coolant gas for flow through said passage;

wherein the shroud extends from or adjacent to the inlet end and has a lower end thereof which is spaced above said lower end portion, and wherein the passage is open at the lower end of the shroud, whereby when said lower end portion is submerged in the slag, coolant gas supplied to said passage is able to discharge exteriorly of the lance, above the slag.

2. A lance according to claim 1, wherein said first tube is at least two meters in length, and said shroud terminates at least 300 mm above the lower end of said first tube.

3. A lance according to claim 1, wherein said first tube is at least two meters in length, and said lower end portion of said first tube is from $\frac{1}{4}$ to $\frac{1}{3}$ of the overall length of said lance.

4. A lance according to claim 1, wherein said first tube has an external diameter of from 25 to 400 mm, with said annular passage having a radial width of from 2.5 to at least 20 mm; said first tube and said shroud each having a wall thickness of from 2 to at least 6 mm.

5. A lance according to claim 4, wherein said lance has a length of about 2 to 5 meters, said first tube having an external diameter of about 25 to 35 mm, with said passage having a width of from about 2.5 to 5 mm.

6. A lance according to claim 4, wherein said lance has a length of from about 4 to 8 meters, said first tube having an external diameter of 35 to 100 mm, with said passage having a width of from about 4 to 10 mm.

7. A lance according to claim 4, wherein said lance has a length in excess of 8 meters, said first tube having a diameter in excess of 100 mm, and said passage having a width of from 5 to at least 20 mm.

8. A lance according to claim 1 wherein a rod extends within said first tube, with a helical swirler strip extending around said rod to provide a swirler assembly for imparting swirl to fluid passed through said first tube.

9. A lance according to claim 7, wherein a second tube extends within said first tube, with a helical swirler strip extending around said second tube to provide a swirler assembly for imparting swirl to fluid passed through said first tube between the latter and the second tube.

10. A method of injecting fluid into a liquid pyrometallurgical bath comprising slag or having a slag layer on its surface, the method comprising the steps of:

(a) mounting, above the bath, a lance for top submerged injection of fluid into the bath, the lance relative to its in-use orientation being of elongate form between an upper inlet end thereof and a lower discharge end for said fluid, the lance having a lower portion which terminates at said discharge end and which, in use, is submergible in said slag; the lance comprising:

(i.) at least one first elongate tube which extends between said upper and discharge ends and which defines a duct for the flow of said fluid from the inlet end for discharge from the discharge end, the at least one first tube defining said lower portion;

(ii.) an elongate, tubular shroud which is mounted in relation to the at least one tube, and through which the first tube extends, so that a coolant gas flow passage is defined within the shroud and around the first tube;

(iii.) first connector means, at said inlet end, connected to a pressurized source of supply of said fluid for flow of said fluid through said duct; and (iv.) second connector means, at said inlet end, connected to a pressurized source of supply of said coolant gas for flow through said passage;

wherein the shroud extends from or adjacent to the inlet end and has a lower end thereof which is spaced above said lower end portion, and wherein the passage is open at the lower end of the shroud, whereby when said lower end portion is submerged in the slag, coolant gas supplied to said passage is able to discharge exteriorly of the lance, above the slag;

(b) passing the fluid through the at least one first tube of the lance for discharge through the lower, discharge end of the first tube;

(c) simultaneously with step (b), passing a coolant gas through the passage defined within the shroud of the lance and around the first tube for discharge at the lower end of the shroud;

(d) lowering the lance to a first position at which the discharge end of the first tube is adjacent to the surface of the slag whereby the fluid being discharged from the first tube causes splashing of the slag;

(e) holding the lance in that position whereby splashes of slag deposit exteriorly on the first tube and the shroud;

(f) maintaining a sufficient flow of coolant gas through the passage such that the coolant gas in combination with the fluid cools the lance to thereby solidify the splashes of slag deposited on the lance to form a protective coating of solid slag; and (g) lowering the lance to a second position inserting the discharge end of the at least one tube into the bath for discharge of the fluid therein, the lower end of the shroud with the lance in the second position being above the bath whereby the coolant gas continues to cool the lance prior to discharge of the coolant gas above the surface of the slag.

11. A top submerged lancing furnace installation for use in injecting fluid into a liquid pyrometallurgical bath comprising slag or having a slag layer on its surface, the installation comprising:

(a) a furnace in a lower region of which the liquid bath is able to be established to a required level;

(b) at least one lance for top submerged injection of fluid into the bath, the lance relative to its in-use orientation being of elongate form between an upper inlet end thereof and a lower discharge end for said fluid; the lance having a lower portion which terminates at said discharge end and which, in use, in submergible in said slag; the lance comprising:

(i.) at least one first elongate tube which extends between said upper and discharge ends and which defines a duct for the flow of said fluid from the inlet end for discharge from the discharge end, the at least one first tube defining said lower portion; and (ii.) an elongate, tubular shroud which is mounted in relation to the first tube, and through which the first tube extends, so that a coolant gas flow passage is defined within the shroud and around the first tube;

wherein the shroud extends from or adjacent to the inlet end and has a lower end thereof which is spaced above said lower end portion, and wherein the passage is open at the lower end of the shroud, whereby when said lower end portion is submerged in the slag, coolant gas supplied to said passage is able to discharge exteriorly of the lance, above the slag;

(c) means for lowering the lance into the furnace, the lowering means being operable to lower the lance to a first position at which the discharge end of the first tube is adjacent to the surface of the slag and, after holding the lance at the first position, to further lower the lance to a second position in which the discharge end of the first tube is inserted into the bath with the lower end of the shroud being above the bath;

the first tube of the lance being connectable at the upper end thereof to a source of pressurized fluid to be passed through the duct of the first tube during and after lowering the lance whereby fluid being discharged from the first tube causes splashing of the slag so that slag deposits exteriorly on the first tube and the shroud, with the lance in the first position, to enable splashes of slag on the lance to form a protective coating, and whereby the discharged fluid is injected into bath with the lance in the second position; the shroud being connectable at the upper end thereof to a source of pressurized coolant gas to be passed through the passage within the shroud during and after lowering of the lance whereby the coolant gas in combination with the fluid cools the lance so that, with the lance in the first position, the splashes of slag solidify to form such protective coating, and whereby the coolant gas is discharged into the furnace above the bath, with the lance in the second position, to continue to cool the lance.

* * * * *